United States Patent [19]

O'Neal et al.

[11] 4,190,116

[45] Feb. 26, 1980

[54] MINE ROOF BOLTER

[75] Inventors: Winston R. O'Neal, Fayetteville; Stephen L. Richardson, Oak Hill, both of W. Va.

[73] Assignee: Black Diamond Service Company, Inc., Fayetteville, W. Va.

[21] Appl. No.: 902,397

[22] Filed: May 3, 1978

[51] Int. Cl.[2] ..... E21C 5/00

[52] U.S. Cl. ..... 173/38; 74/467; 173/57; 173/163; 173/DIG. 3; 299/12

[58] Field of Search ..... 74/467, 468, 479; 173/38, 57, 163, DIG. 3; 175/213; 184/6.12, 13 R; 299/12

[56] References Cited

U.S. PATENT DOCUMENTS

| | | | |
|---|---|---|---|
| 1,474,491 | 11/1923 | Perkins | 184/13 R X |
| 2,680,165 | 6/1954 | Hasselbaum | 74/480 X |
| 3,032,129 | 5/1962 | Fletcher | 175/213 X |
| 3,132,702 | 5/1964 | Schrum et al. | 173/DIG. 3 |
| 3,252,525 | 5/1966 | Pyles | 173/38 X |
| 3,547,206 | 12/1970 | Phillips | 173/57 X |
| 3,741,318 | 6/1973 | Klein et al. | 173/57 X |
| 3,901,330 | 8/1975 | Slator et al. | 173/57 |
| 3,990,522 | 11/1976 | Pyles et al. | 173/78 |

FOREIGN PATENT DOCUMENTS

| | | | |
|---|---|---|---|
| 121092 | 12/1918 | United Kingdom | 184/13 R |

*Primary Examiner*—Lawrence J. Staab
*Attorney, Agent, or Firm*—Depaoli & O'Brien

[57] ABSTRACT

A mine roof bolter is described which has a rotary drill head with: (1) sufficient rotative mass that breakage of bits and steel is minimized, (2) a dual drive assembly that provides balanced side thrusts against the bearings so that wear thereof is minimized, (3) a sealing assembly that protects the lubricating oil from contamination by dust and mud under very adverse conditions, (4) circulatory lubricating devices that provide oil to the sealing assembly and drive assembly, and (5) a dust collecting assembly which is suitable for fast and simple cleaning. The mine roof bolter additionally has a lift arm which is constructed with three parallelograms providing useful spatial advantages and a panic bar assembly which enables an operator to stop all hydraulic and electrical systems from two sides of the machine.

19 Claims, 11 Drawing Figures

NOTE: Internal oil circulation →
Seals from possible dust leaks →
Seals from possible exterior contamination →
Regular dust path →

FIG. 1
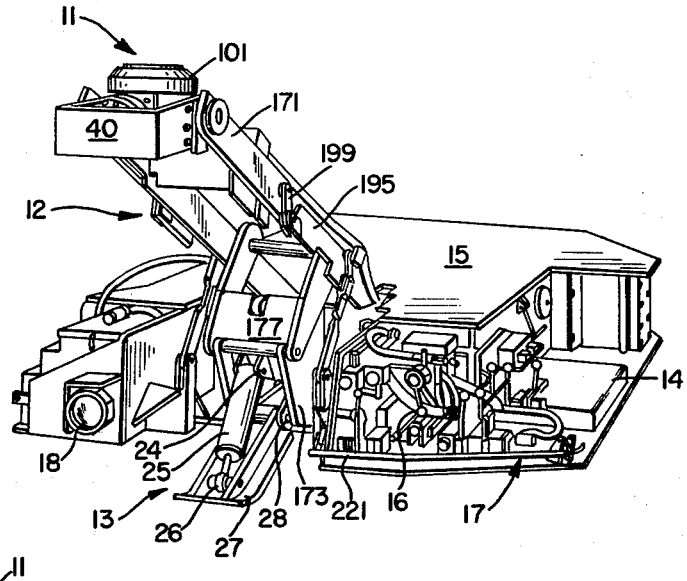
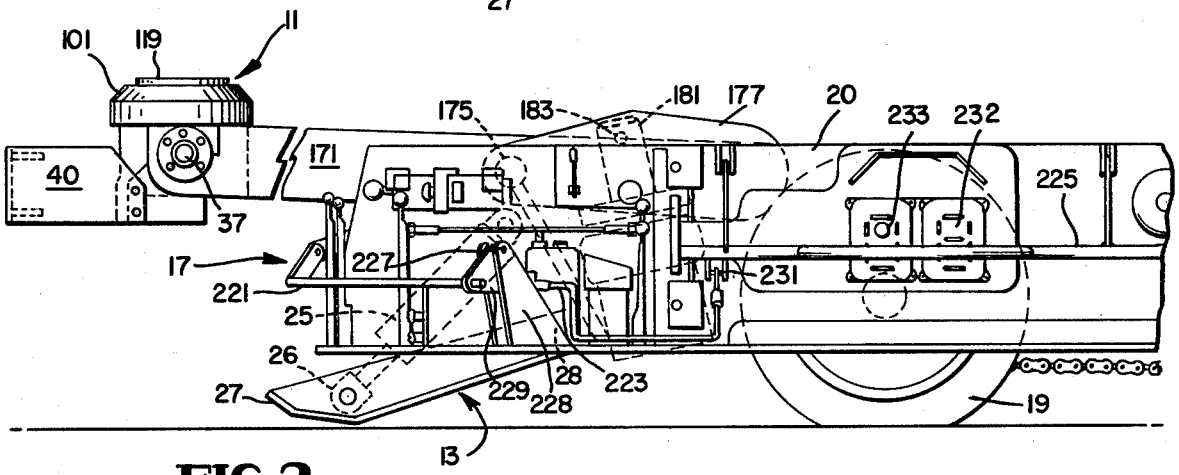
FIG. 2
FIG. 3
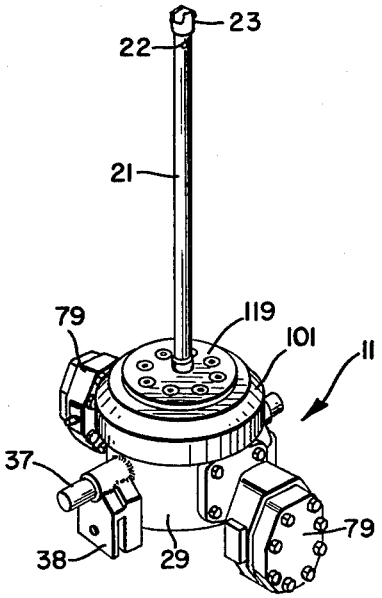

NOTE: Internal oil circulation ⟶
Seals from possible dust leaks ⇨
Seals from possible exterior contamination ▷
Regular dust path ⟶

MINE ROOF BOLTER

BACKGROUND OF THE INVENTION

1. Field of the Invention

This invention relates to mine vehicles and particularly relates to such vehicles having a rotary boring tool, a rectilinear elevation means for the boring tool, and a power means which is the source of energy for imparting torque to the boring tool, movement to the elevation means, and travel to the vehicle. It especially relates to sealing means for excluding contaminants from the boring tool, to bearing means for maintaining its stationary and rotating parts in alignment, and to lubricating means for the sealing means and bearing means.

2. Review of the Prior Art

Tunnelling and continuous mining involve considerable hazards to operators from falling rock. Nearly one-half of the fatal injuries received in coal mining in the United States are caused by roof falls, particularly where blasting is involved in tunnel mining beneath thin limestone, shale, or sandstone strata.

As a protective measure, it has become standard practice to install roofing bolts, spaced apart at selected distances, perpendicularly into the strata in order to bind them together and prevent delamination and sequential collapse of a stratified roof.

Such roofing bolts may be up to seven feet in length and weigh twenty pounds or more. They are inserted by the operator into a hole which he has bored into the mine roof with a roof-bolting machine until he senses that hard strata is being encountered. The bolt is made of soft iron and in low-roof mines is supplied to the operator in a curved shape with a plate of oak or steel at its head. The operator pushes and straightens the bolt until he can use the roof-bolting machine to thrust it securely into place and then to tighten or torque the bolt with a selected force, such as 150 foot-pounds.

In present-day coal mining, about one bolt out of four is a resin bolt which is formed by loading three bags of epoxy components into the bored hole before the bolt is inserted. Turning the bolt breaks the bags and mixes their contents during a forty-second interval before hardening occurs. The resinous material tends to drip down upon the rotary drill head therebeneath, causing damage thereto.

In any of these operations, the operator is exposed to danger from falling rock because he has to work under unsupported roof shortly after blasting operations. He is therefore working under pressure to shore up the roof with oak logs along the edges of a newly blasted portion of the tunnel and then to bolt the roof at required space intervals (such as four feet apart on centers) as soon as possible.

The mine floor is generally wet and more or less covered with a mucky mixture of coal dust and water. Water additionally drips from the roof of the mine. The drill head of the roof bolter generally is provided with a dust collection means, such as that described in U.S. Pat. No. 3,319,727 of Harry G. Pyles, so that its internal rotating machinery is subject to invasion by dust particles from the dust collecting path. In addition, invasion by water from overhead drippings and by wet coal dust, when the drill head is even momentarily lowered to the floor of the mine, is constantly likely. Even slight contamination of the oil which lubricates the drill head is sufficient to wear its seals completely out. The lubricating oil is then sucked into the dust collecting apparatus, often causing plugging thereof. The drill head quickly runs dry, causing the life of a rotary drill head or drill pot typically to be 6–18 months of active service.

This situation is indeed intensified by the confined, dirty, and dangerous working conditions which tend to cause the operators to be oblivious to long-term maintenance responsibilities. It is therefore essential that a sealing means be provided in a drill head whereby the most hasty and even careless operation of the roof bolting machine will not enable dirt to enter its lubricating system from the dust collection system at the center of the drill head, from its upper periphery, or from its bottom when placed on a wet and mucky mine floor.

Such a sealing means is available in the vehicular machine art but has heretofore not been used in the drill head of a roof bolter. It is the sliding mechanical seal which comprises a pair of steel seal rings having circumferentially sliding lapped mating surfaces, each steel ring being compressed by a toric or elastomeric ring which seals an annular space between the respective ring and either a stationary or a rotating member of the machine. This seal is described in U.S. Pat. No. 4,077,634 and in earlier patents such as U.S. Pat. Nos. 3,524,654 and 3,403,916. Commercial products of this type are sold, for example, under the trademark, Duo-Cone, by Caterpillar Tractor Company, Peoria, Illinois, and under the trademark, DF Heavy Duty Seal, by Chicago Rawhide Manufacturing Company, 2720 N. Greenview Avenue, Chicago, Illinois.

However, these seals are built for operation in a vertical or at least an inclined plane so that they rotate partially within a bath of lubricating oil. Moreover, it is not possible to fill the head of a roof bolter to its capacity because the fluid expands 10% when hot. For use within the drill head of a roof bolter, sliding mechanical seals must operate in a horizontal plane between portions of its stationary and rotating assemblies. Accordingly, an overhead lubricating means is needed that will reach and lubricate a sliding mechanical seal and also lubricate the uppermost bearings of the bearing assembly and pinion of the drive assembly within the drill head.

Another problem that has plagued roof bolters of the prior art is bearing failure caused by side thrust at the upper part of the drill head. The side thrust creates sufficient wear of the upper bearings that the entire vertical thrust is then placed upon a few of the bottom bearings so that their life is relatively short. For example, as little as two-thousandths of an inch of wear can cause substantially all vertical thrust to be exerted against only two or three of the bottom thrust bearings. Such side thrust is believed to be at least partially created by the unbalanced rotary thrust from a single hydraulic motor. Accordingly, a means for imparting a balanced rotary thrust is needed.

Such side thrust is also believed to be created by pivotal forces that develop when drilling into inclined strata or when the bit meets an embedded boulder of flint along one side of the borehole. It is further believed that the bearing assemblies of prior art roof bolters have insufficient span between their upper and lower bearings so that the leverage that is developed by these pivotal forces tends to become tremendous and overwhelms their inadequate bearing capacity. A bearing assembly having adequate vertical span and bearing means for resisting the side thrusts developed by pivotal forces is therefore essential.

A third problem that has troubled roof bolters of the prior art is bit breakage when operating in hard roof conditions, such as in sandstone strata. A cause thereof is believed to be insufficient mass in rotary motion. For example, the drill head of one widely used roof bolter weighs no more than about 50 pounds. Such a low mass creates inadequate momentum when the bit contacts a hard spot in the mine roof, thereby forcing the rotary drill head to pause and then to transfer accumulated momentum to the steel bit and its extensions, whereby excessive torsional stresses are created. A means for preventing such accumulation of momentum at rotational speeds up to about 500 rpm is accordingly needed.

A fourth problem of a simple but practical nature that has impeded the operations of prior art roof bolters is the difficulty of opening up and clearing their dust collection system within the drill head when it is clogged by dust mixed with moisture or oil. A simple and rapid means for opening up and forcibly clearing these passages is accordingly needed, one that is dependably available in the dim light of a coal mine even when an operator is tired, in a hurry, and kneeling in a pool of muddy water.

A fifth problem involves protecting the operator from falling rock and guiding the drill steel while drilling. Finding an efficient and compact means for solving this two-sided problem has long plagued the designers of roof bolting machines because it involves the combination of a rotary drill head with an automatically operating roof support, which will rise synchronously with the drill head in order to furnish protection to the operator from falling rock, and with a guide means to keep the drill steel in line while drilling. The crux of this problem is the means and location for attaching the roof support assembly to the frame of the roof bolter.

A sixth problem which has much importance for operators of roof bolting machines is emergency stoppage of the roof bolter at any time, for any reason, and from a variety of operating positions while it is being operated in a mine. Prior art machines are equipped with such emergency devices, but they lack an emergency stopping means that can enable the operator to stop the entire electrical and hydraulic systems of the roof bolter by a single reflex motion without looking at the controls, indeed even in total darkness, from any position along two adjacent sides of the machine, and within lunging distance thereof.

SUMMARY OF THE INVENTION

It is accordingly an object of this invention to provide a seal assembly, including a sliding mechanical seal, for excluding dirt and water from the lubricating oil within a drill head of a mine roof bolter and for excluding this lubricating oil from its dust collection passages.

It is also an object to provide a circulatory lubricating system for reaching and lubricating the seal assembly of a drill head, its bearing assembly, and its drive assembly.

It is further an object to provide a balanced rotary thrust within a drill head of a roof bolter.

It is additionally an object to provide a bearing assembly having high resistance to side and vertical thrust loads within a drill head of a roof bolter.

It is another object to provide a means for preventing the accumulation of rotational momentum and its transference by the drill head as torsional stresses to the drill steel.

It is still another object to provide a means for rapidly opening up and dependably clearing the dust collection passages within a drill head of a mine roof bolter.

It is still further an object to provide a means for attaching a roof support assembly to a roof bolter whereby the roof support assembly will rise synchronously with the drill head.

It is a final object to provide an improved emergency stopping means for shutting off all hydraulic and electrical systems from two adjacent sides of a roof bolter.

In accordance with these objectives and the principles of this invention, a rotary drill head of a mine roof bolter is herein described that comprises a stationary assembly, a rotative assembly, a sealing assembly, a bearing assembly, a circulatory lubricating means, a balanced drive means, and a dust collection means. More specifically, the rotary drill head includes a rotative assembly possessing a mass of at least 100 pounds and a rotational speed of at least 400 rpm so that the rotary drill head is relatively immune to breakage of bits that is caused by sudden contact of a bit with hard strata and the consequent accumulation of torsional stresses within the drill steel when rotation of the bit momentarily stops; a bearing assembly including thrust bearings receiving axially delivered thrust, tapered roller bearings for receiving side thrusts at the upper portions of the drill head, and roller bearings for receiving side thrust at the bottom portions of the drill head; dual hydraulic drive means which are disposed in 180° relationship so that they transmit a balanced rotary thrust to the drive head; a sealing assembly for retaining lubricating oil within the rotary drill head and for excluding dirt and water that comprise an inner mechanical seal between the lubricating oil and the dust collection passages, an outer mechanical seal between the lubricating oil and the environment, a rotary seal, and a plurality of static seals; a circulatory lubricating means for splashing lubricating oil from an inner pool of lubricating oil onto the uppermost roller bearings and the inner mechanical seal and for centrifugally forcing oil radially outward to the outer mechanical seal, thence to an outer pool of lubricating oil past the ring gear drive means, and finally downwardly and radially inwardly to the inner pool; and a bottom dust passage which is connected along its side to the central hole through the rotary drill head and also to the suction means on the mine roof bolter and which comprises quickly opened end coverings at its opposed ends.

The stationary assembly comprises: a case having a circumferential side and a bottom with a central hole therein; a dust collection assembly comprising a straight pipe, with easily opened closure members at each end thereof, which is disposed outside of the case and is connected along its side to the central hole and also to the suction means on the roof bolter; a spindle having a base portion and a shaft or central cylindrical portion; a seal retainer which is attached to and is supported by the central cyclindrical portion at its upper end, and an attachment assembly. The spindle has a coaxial opening from the top of the central cylindrical portion to the bottom of the base portion. The base portion is rigidly attached to the bottom of the case so that the central opening in the case is aligned with the coaxial opening in the spindle.

The rotative assembly comprises: a cylindrical hub; a ring gear and a seal plate which are rigidly attached to and supported by the hub; a chuck which is rigidly attached to the seal plate; and an insert assembly which connects the top of the spindle to the chuck plate and forms a rotating extension of its coaxial opening and which also receives and holds the drill steel. In one preferred embodiment, the rotative assembly weighs 113 pounds.

The cylindrical hub coaxially surrounds and is radially spaced from the cylindrical portion of the spindle to define an inner oil cavity therebetween and is also radially spaced from the circumferential side of the case to define an outer oil cavity therebetween. The cylindrical hub is further vertically spaced at its lower thrust-transmitting end, by thrust bearings and a pair of races, from the base portion of the spindle.

The ring gear and seal plate are rigidly attached to and supported by the hub at its thrust-receiving end. The ring gear is coaxially disposed to and radially spaced outwardly from the hub. The seal plate has a plurality of oil passageways therein which are diagonally and radially disposed.

The chuck is rigidly attached to the seal plate and comprises a central opening which is aligned with the coaxial opening of the spindle, an inner recess which coaxially surrounds and is spaced from the seal retainer, an outer opening which is coaxially connected to the inner recess by the central opening, an outer circumferential flange, a circumferential groove which is spaced radially inwardly from the flange, and a plurality of oil passageways which are aligned with and connected to the oil passageways in the seal plate so that the inner oil cavity is connected to the circumferential groove.

The insert assembly comprises: a cylindrical spindle insert which is inserted into and fits closely within the coaxial opening within the cylindrical portion of the spindle and also within the central opening within the chuck; a spacer which fits closely adjacent to the spindle insert and to the outer opening in the chuck; a splined insert which fits nonrotatably into splines along the edge of the outer opening in the chuck; and an insert retainer which is attached to the chuck and has an inner member for securing the splined insert. This splined insert has a square opening into which the drill steel fits. It tends to receive more wear than any other part of the rotary drill head and is rapidly replacable after removing the insert retainer.

The sealing assembly that prevents intermixture of dust, oil, and water comprises a plurality of rotational seals and a plurality of static seals. The rotational seals comprise an outer mechanical seal which rotatably and sealably connects the circumferential side of the case to the circumferential flange of the chuck, an inner mechanical seal which rotatably and sealably connects the seal plate to the seal retainer, and a rotary seal between the spindle and the spindle insert.

The mechanical seals are horiztonally disposed and are sliding seals requiring constant circulatory lubrication, but the rotary seal contains packaged molybdenum disulfide as a lifetime friction lubricant. The outer mechanical seal protects the oil supply from contamination by dust, water, and muck, but the inner mechanical seal protects not only the oil supply from dust contamination but also the dust collection system from oil contamination.

The static seals are disposed between the dust collection assembly and the bottom of the case, between the case and the base portion of the spindle, between the spindle and the seal retainer, between the chuck and the seal plate, and between the chuck and the spindle insert. Thus, they provide a barrier between adjacent parts that are stationary and rigidly attached to each other, so that transmission of minute amounts of water, oil, and dust is prevented.

The bearing assembly comprises three sets of bearings, including thrust bearings which are disposed between the base portion of the spindle and the lower or thrust-transmitting end of the cylindrical hub. Upward thrust against the mine roof, which may be as much as 16,000 pounds, is thus transmitted from the drill steel to the thrust insert and spacer, then to the chuck, and thus to the seal plate, the ring gear, and the thrust-receiving end of the hub. This thrust is then uniformly imparted by the lower end of the hub to the upper race of the thrust bearings which are radially disposed upon a lower race on the base of the spindle. These thrust bearings are also disposed between the inner oil cavity and the outer oil cavity so that oil flowing from the outer oil cavity to the inner oil cavity must pass by and wash clean each of the thrust bearings during normal circulation of the oil while the rotary drill head is in operation.

The bearing assembly further comprises tapered roller bearings which are disposed in the inner oil cavity between the cylindrical portion of the spindle and the upper portion of the hub. These tapered roller bearings receive side thrusts of any type.

The bearing assembly finally comprises roller bearings which are disposed within the inner oil cavity between the cylindrical portion of the spindle and the lower portion of the hub and also between the thrust bearings and the tapered roller bearings. They absorb side thrusts at the lower portion of the hub.

The roller bearings and the tapered roller bearings are thus spaced apart as far as possible in contact with a unitary cylindrical member, the hub, for resisting a sidewise couple created by a sidewise push against the drill steel. In addition, the tapered roller bearings and the thrust bearings cooperatively resist couples having a vertical component which are typically encountered while drilling through inclined strata. Thus, the tapered roller bearings, the roller bearings, and the thrust bearings of the bearing assembly cooperatively maintain the hub and the cylindrical portion of the spindle in coaxial relationship so that the drilling thrust upon the thrust bearings is uniformly distributed thereupon.

The circulatory lubricating means is disposed within the inner oil cavity for moving oil upwardly past the tapered roller bearings, between the seal retainer and the inner mechanical seal, and into the oil passageways through the seal plate and the chuck. Once the oil is introduced into these oil passageways, centrifugal forces cause it to move rapidly therethrough and to flow out into the circumferential groove behind the flange of the chuck from which it falls onto and lubricates the outer mechanical seal. The oil falls downwardly upon the ring gear and pinions and then into the outer oil cavity, from which it flows beneath the hub to the inner oil cavity, so that there is a continual toroidal circulation of oil while the rotary drill head is in operation.

The circulatory lubricating means comprises the oil passageways and an oil lift ring having a coaxial opening and at least one finger which is downwardly inclined in the direction of rotation. This finger may be of any shape and length, but it is preferably formed by cutting out a rectangular tab and bending it so that it is downwardly inclined when the ring is attached to a shoulder within the hub.

The balanced drive means for turning the rotative assembly comprises a pair of pinions, which rotatably engage the ring gear and are rotatively attached to each side of the case at positions 180° apart and within the outer oil cavity, and a pair of hydraulic motors which are connected to the pinions and to a hydraulic drive motor by hydraulic transmission lines.

This dual-drive system reduces the load on each motor to one half the load in prior art drill heads and increases the life of the motor by a factor of three to four times.

This rotary drill head is usable on any roof bolter having a lift arm furnishing rectilinear elevation, a dust collection means which includes a vacuum pump and a dust collecting filter, and a hydraulic power-generating means on the vehicle.

When an automatic roof support assembly is to be mounted on the frame of a roof bolter, the lift arm therefor must have means for being raised synchronously with the rotary drill head and on a direct line therewith, perpendicularly to the main frame of the roof bolter. It is particularly necessary to have such synchronous lifting when a guide means for the drill rod is attached to the lift arm for the automatic roof support.

The lift arm of this invention is constructed with three parallelograms in its leveling mechanism and with sufficient width that the lift arm for the automatic roof support can be attached deep inside the frame of the roof bolter. A cross-over lever assembly is provided to connect the front parallelogram, which is inside the lift arm frame, to the rear parallelogram, which is outside the lift arm frame. The additional width also provides space for mounting the lift cylinder and a massive member of the frame, whereby bending of the lift arm frame cannot reasonably occur. The panic bar assembly is segmented, includes a connecting means that permits a small amount of angular play and is pivotably mounted on two adjacent sides of the machine. The connecting means includes a suitably bent rod, so that it can be inserted through a maze of hydraulic piping, which has sufficient rigidity that it can transmit a vector component of a thrusting force from the curved front panic bar to the shut-off bar on the side of the machine. In general, the panic bar assembly utilizes a curved panic bar, pivotal mountings that enable a force to be applied in a different direction from the direction of push made by the operator and pivotal connections on each end of the bent rod between the curved panic bar and the shut-off bar.

BRIEF DESCRIPTION OF THE DRAWINGS

FIG. 1 is a top perspective view of the mine roof bolter of this invention from the left front side.

FIG. 2 is a left side view of the mine roof bolter shown in FIG. 1.

FIG. 3 is a perspective view of the rotary drill head with a drill rod in place.

DESCRIPTION OF THE PREFERRED EMBODIMENTS

Figure 4:
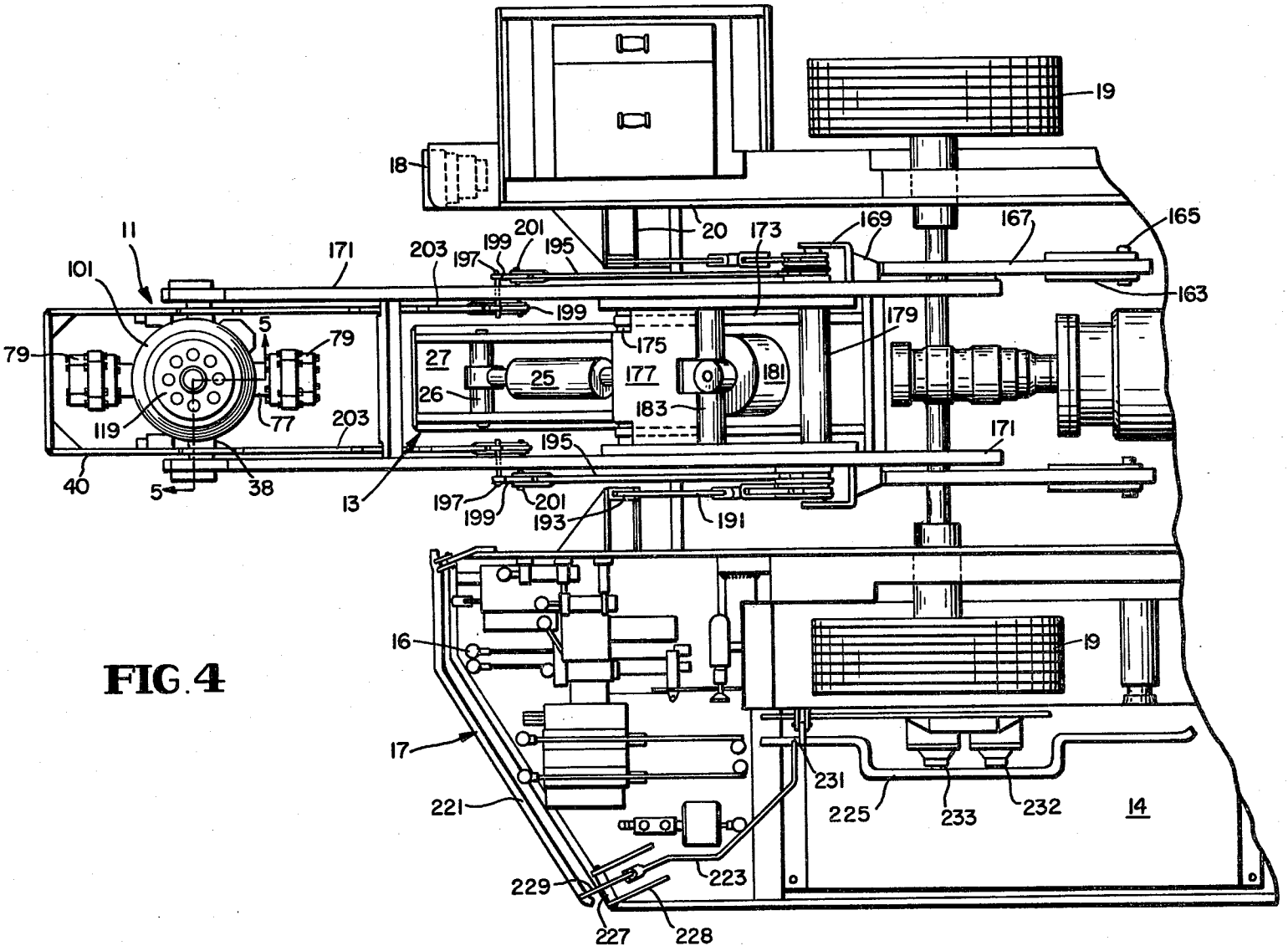
FIG. 4 is a plan view of the front portion of the mine roof bolter shown in FIGS. 1 and 2, with the flat roof removed.

The mine roof bolter as shown in FIGS. 1, 2, and 4 comprises a rotary drill head 11, a lift arm assembly 12 to the outer end of which the rotary drill head is attached, a stabilizer foot 13, an operator's station 14, a flat top 15, hydraulic controls 16, a panic bar assembly 17, headlights 18, and wheels 19.

Figures 5, 6, 6A:
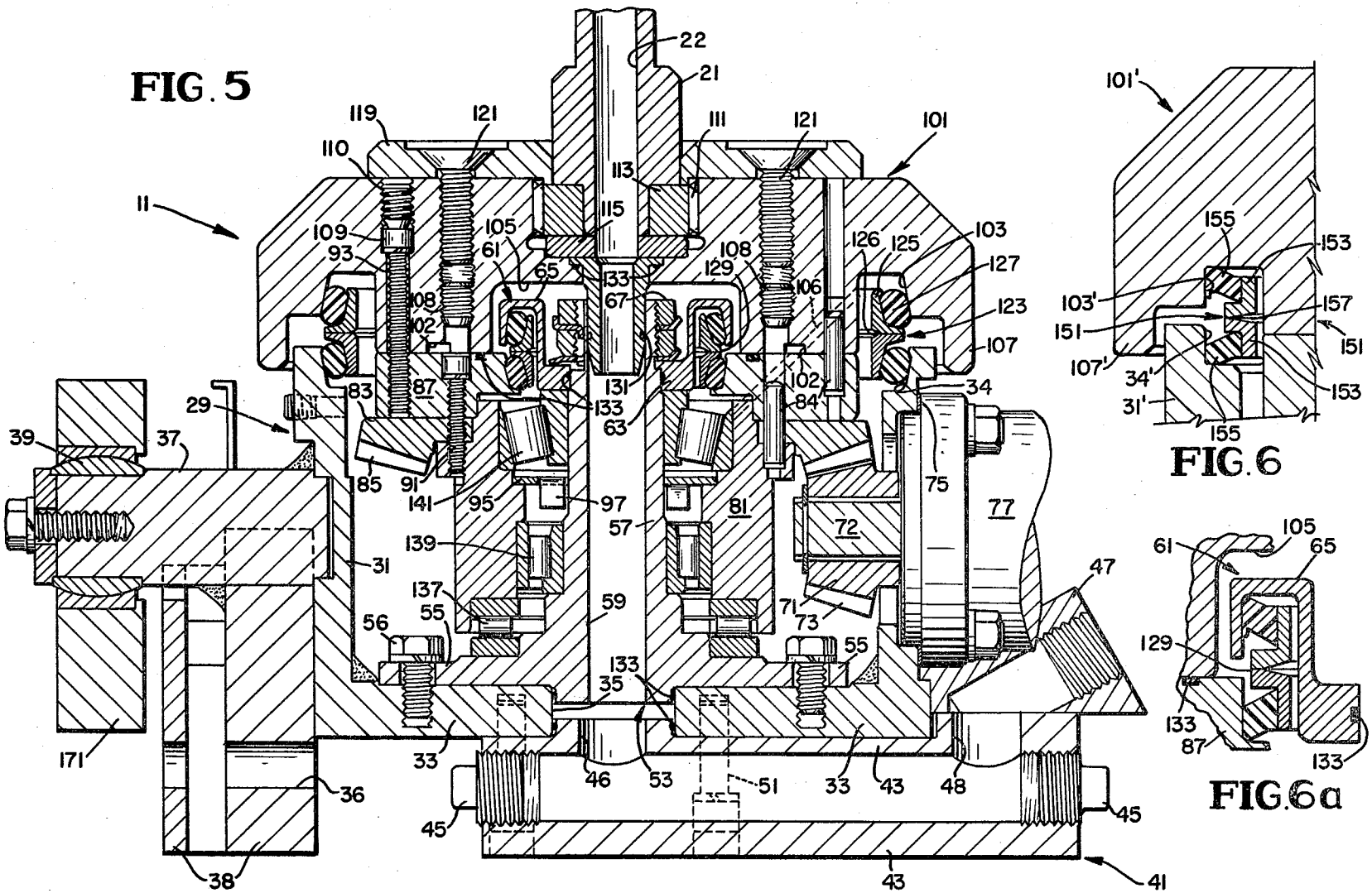
FIG. 5 is a vertical cross-section, through the rotary drill head, looking in the direction of the arrows 5—5 in FIG. 4.
FIG. 6 is a partial sectional view showing an alternative mechanical seal as the outer seal in position between the chuck and the side of the case.
FIG. 6*a* is another partial sectional view showing the same alternative mechanical seal as the inner seal in position between the seal retainer and the seal plate.
Figure 7:
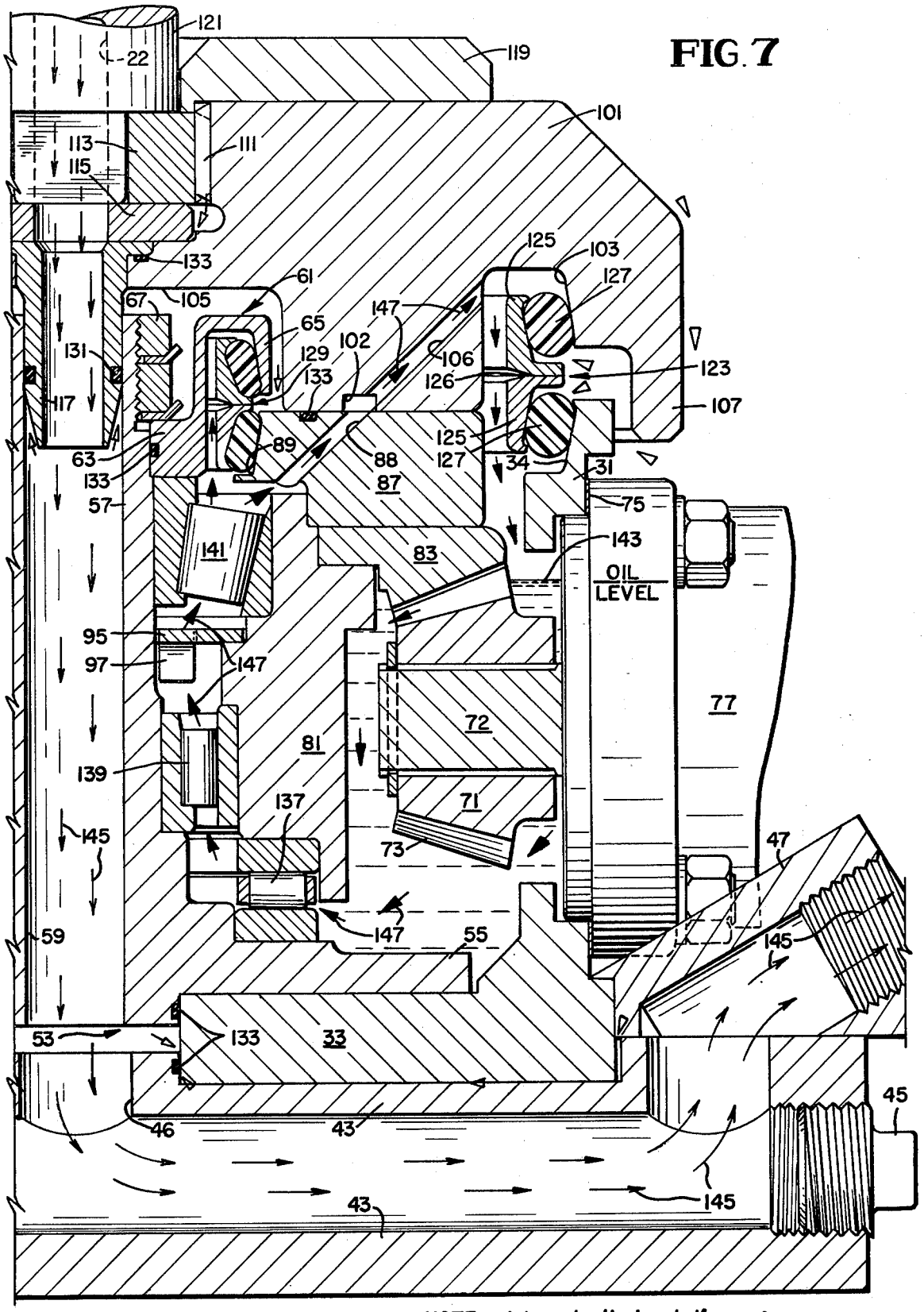
FIG. 7 is a partial vertical sectional view, showing approximately one-half of the rotary drill head on a large scale, as compared to FIG. 5, and illustrating the dust collection path and the toroidal circulation of lubricating oil.

The rotary drill head 11, as particularly shown in FIGS. 3, 5 and 7, comprises a stationary assembly, a rotative assembly, a sealing assembly, a bearing assembly, a circulatory lubricating means, a balanced drive means, and a dust collection means. The stationary assembly comprises a case 29, a dust collection assembly 41, a spindle 53, a seal retainer 61, and an attachment assembly. Case 29 has a circumferential side 31, a bottom 33, a circumferential seal seat 34, and a central hole 35. The attachment assembly, which is attached to side 31, comprises, in pairs, a stationary shaft 37, leveling rod lugs 38, a spherical bearing 39, and a guard 40.

Dust collection assembly 41 comprises a straight pipe 43 which is attached to bottom 33 of case 29 with cap screws and lock washers 51, a pair of pipe plugs 45 which are threadably attached to each end of pipe 43, an inet hole 46 which is coaxially aligned with central hole 35, an outlet hole 48, and a dust path connector 47 which is attached to one end of pipe 43 and connected to outlet hole 48. Inlet hole 46 and outlet hole 48 are each in the side of pipe 43.

Spindle 53 is a solid member comprising a radially extended base 55, which is attached by cap screws 56 to bottom 33, and an elongated central shaft 57 having a central hole or bore 59 therewithin which is coaxially aligned with holes 35 and 46. Base 55 has a radially disposed channel upon which thrust bearings 137 are mounted, and spindle 57 has three circumferential channels upon which roller bearings 139, tapered roller bearings 141, and base 63 of seal retainer 61 are mounted. Additionally, it is equipped with threads at its upper end for receiving a bearing lock washer and nut assembly 67.

The balanced drive means comprises, in pairs, a pinion 71 having pinion teeth 73 which is attached to a pinion shaft 72, which rotates within a motor connection 77, a motor 79, and shims 75 which sealably enclose shaft 72 and keep case 29 in oil-tight condition so that oil level 143 can be maintained during long periods of operation of the mine roof bolter.

The rotative assembly comprises a cylindrical hub 81, a ring gear 83, a seal plate 87, dowel pins 84, cap screws 91 and 93, set screws 108 and 110, an oil lift ring 95, a chuck 101, a splined insert 113, a spacer 115, a spindle insert 117, an insert retainer 119, flat socket head screws 121, and portions of the mechanical seals and bearings.

Cylindrical hub 81 possesses a pair of radially disposed channels on its outer surface and near its upper end upon which ring gear 83 and seal plate 87 are mounted and which receive vertical thrust that is transmitted to hub 81. At its lower end is another radially disposed channel which receives the upper race of thrust bearing 137 and which transmits the vertical thrust thereto. Along its inner surface, which coaxially surrounds and is radially spaced from central shaft 57 to define an inner oil cavity therebetween, are two longitudinally disposed channels and one radially disposed channel therebetween. The outer races of roller bearings 139 and tapered roller bearings 141 are mounted in the longitudinally disposed channels, and one flat surface 96 of an oil splash ring 95 is attached with screws in attachment holes 99 in the radially disposed channel.

As shown in FIGS. 5 and 7, ring gear 83 has teeth 85 which mesh with teeth 73 of pinion 71. Seal plate 87 rests upon the upper surface of ring gear 83 and against one of the channels of hub 81. Seal plate 87 has four oil passageways 88 which extend diagonally upwards from the vicinity of tapered roller bearings 141, and indeed are almost collinear with the inner surface of the outer race thereof. Ring gear 83 and seal plate 87 are attached to hub 81 and to each other with a plurality of dowel pins 84 and cap screws 91, as shown in FIG. 5. Seal plate 87 receives vertical thrust from chuck 101 thereabove and transmits the thrust to ring gear 83 and to hub 81.

Chuck 101 comprises a circumferential seal shoulder 103, a narrow circumferential flange 107 which is disposed farther from the axis of chuck 101 than is seal shoulder 103 and which extends downwardly farther than the upper edge of case side 31, a coaxial inner recess 105, and a plurality of oil passageways 106 which are aligned with oil passageways 88 in seal plate 87. A circumferential passageway 102, cut into the bottom of chuck 101, connects all passageways 88, 106 to each other and is intersected by the smooth bores into which dowels 84 are inserted and the threaded sockets into which cap screws 91 are driven. In order to seal the passageway 102 and prevent leakage therefrom, a set screw 108 having a conical bottom, is threadedly tightened against the smooth bore above each cap screw 91 and each dowel pin 84. Chuck 101 is attached to seal plate 87 with a plurality of set screws 110, high-collar lock washers 109, and cap screws 93. Chuck 101 further comprises an outer recess which is also coaxially disposed and connected to inner recess 105, with a radially disposed shoulder therebetween, and which has spline teeth 111 along its outer surface.

A spacer 115 fits against this radially disposed shoulder, and a splined insert 113, having splined teeth along its outer edge, is slideably inserted into the outer recess to rest against spacer 115 and engage spline teeth 111. An insert retainer or top plate 119 is then placed upon the top surface of chuck 101, and flat socket head screws 121, as shown clearly in FIGS. 3 and 5, are inserted on top of all set screws 108 in order to fasten seal plate 119 to chuck 101 and lock set screws 108 in place.

A hollow drill rod 21, having a square end and a suction hole 22, is fitted during operation of the mine roof bolter into the square opening of splined insert 113 and equipped with a drill bit 23.

A sealing assembly comprises a plurality of rotational seals and a plurality of static seals. The rotational seals are outer mechanical seal 123, inner mechanical seal 129, and rotary seal 131. Illustratively, seal 123 comprises a pair of seal rings 125 and a pair of elastomeric torics 127. The seal rings 125 form a mating seal 126 therebetween having a slight angle such as 8°. As the sliding surfaces of seals 125 continue to wear during the use of the rotary drilling head, pressure exerted by torics 127, which are compressed between seal shoulder 103 and seal seat 34, move the engagement area farther and farther inward. The upper ring 125 moves slideably at the same rpm as chuck 101, and the lower ring 125 remains stationary under control of edge 31 of case 29.

Similarly, inner seal 129 comprises a pair of seal rings and a pair of torics. The upper toric is compressed between the upper seal ring and the outer ring 65 of seal retainer 61. The lower toric is compressed between the lower seal ring and seal seat 89 of seal plate 87. Accordingly, the lower seal ring and toric of inner mechanical seal 129 rotate with chuck 101 and seal plate 87, but the upper seal ring and upper toric of inner mechanical seal 129 remain stationary, under the control of seal retainer 61 and spindle 53. Seals 127 and 129 are, as illustrated, manufactured by Caterpillar Tractor Company, Peoria, Illinois under the registered trademark, DUO-CONE SEALS.

Another mechanical seal is illustrated in FIGS. 6 and 6a as an alternative which is highly suitable for the rotary drill head of this invention. Describing the seal of FIG. 6 only, outer mechanical seal 151 comprises a pair of seal rings 153 and a pair of elastomeric torics 155. The sliding and engagement surfaces of rings 153 form a mating seal 157 as shown in FIG. 6. The upper toric 155 is compressed between the upper ring 153 and the seal shoulder 103' which is longitudinally disposed instead of obliquely disposed as is the seal shoulder 103. Similarly, the lower toric 155 is compressed between the lower ring 153 and seal seat 34' which is also longitudinally disposed as contrasted to seal seat 34 which is shown in FIG. 7. The mechanical seal 151 which is shown in FIG. 6 is of the type marketed by Chicago Rawhide Manufacturing Co., 2720 North Greenview Avenue, Chicago, Illinois under the trademark, "DF HEAVY DUTY SEAL HDS". Rotary seal 131 is manufactured by the Parker Packing Company, P.O. Box 1505, Salt Lake City, Utah under the trademark "POLYPAK SEAL". It contains molybdenum disulfide as a permanent lubricant and is in the form of a V-packing with an o-ring inside of the packing.

There are five static seals 133 in the form of o-rings. As shown most clearly in FIG. 7, one static seal 133 is between chuck 101 and spindle insert 117 to protect inner recess 105 from intrusion of contaminants falling from the drilling area thereabove. Another static seal 133 is between the base 63 of the seal retainer 61 and one of the channels of shaft 57 to protect the inner oil cavity from intrusion of contaminants that might enter recess 105. A third static seal 133 is between seal plate 87 and chuck 101 to protect inner recess 105 against intrusion of oil from passageways 88, 106 and to protect the oil flowing through those passageways 88, 106 from intrusion of possible contaminants within inner recess 105. A fourth static seal 133 is between bottom 33 of case 29 and base 55 of spindle 53 to protect the outer oil cavity against intrusion of contaminants such as dust passing through central hole 59 and to protect central hole 59 against intrusion of oil. The fifth static seal 133 is between base 33 and pipe 43 to protect central hole 59 against intrusion of contaminants such as water or muck from the outside of the rotary drill head, as when the rotary drill head is lowered into a pool of water or mucky liquid.

The bearing assembly comprises thrust bearings 137, roller bearings 139, and tapered roller bearings 141. Thrust bearings 137 are mounted with the bottom race against the radial channel of base 55 and the top race in the bottom radial channel of hub 81. Roller bearings 139 are mounted with the inner race engaged with the channel of spindle shaft 57 and the outer race against the corresponding channel of hub 81. Tapered roller bearings 141 are mounted with the inner race against the spindle 57 and the outer race against the top channel of hub 81.

Figure 8:
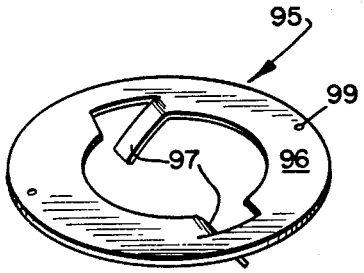
FIG. 8 is a top perspective view of the oil lift ring.

The circulatory lubricating means comprises the radially disposed channel in the inner surface of hub 81, oil lift ring 95, having flat surface 96 and preferably a pair of inclined splash surfaces 97 which dip into the oil bath below the oil level 107 and forceably throw large quantities of oil upwardly into the tapered roller bearings 141 and therebeyond at operating speeds of about 400–475 rpm, and oil passageways 88, 106. Oil lift ring 95 is attached to corresponding threaded holes in the hub channel with screws through attachment holes 99, as seen in FIG. 8.

Figure 9:
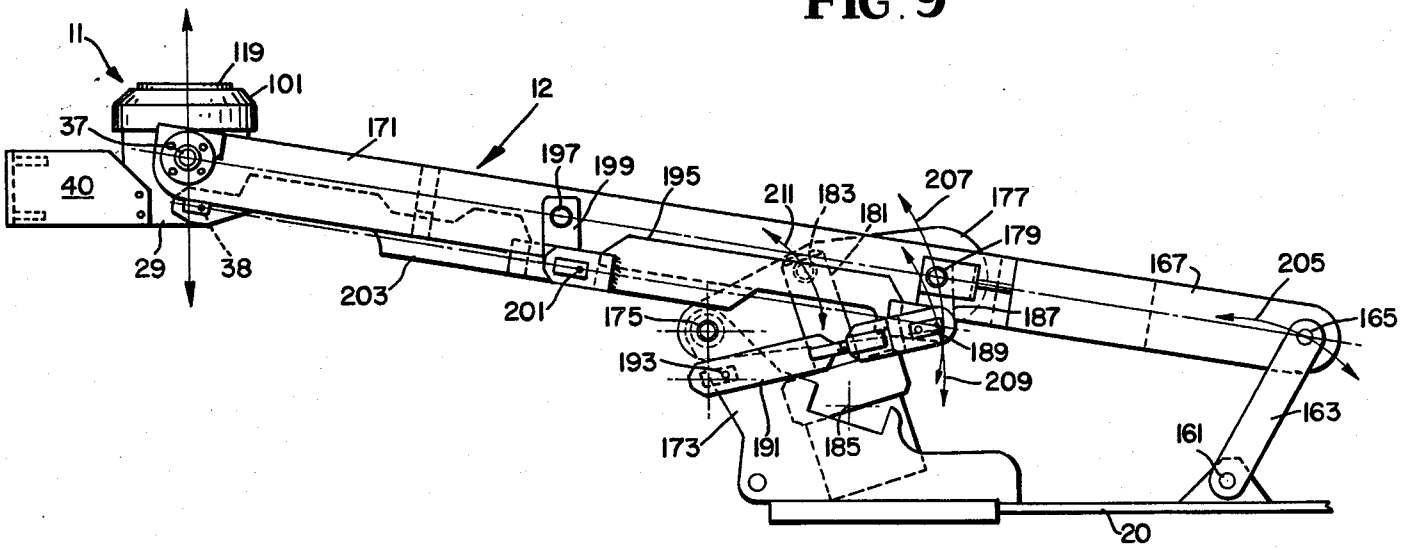
FIG. 9 is a left-side view of the lift arm and the rotary drill head, with arcs to indicate the pivotal action of the supporting arms.

Lift arm assembly 12 is shown in FIGS. 1, 2, 4, 9, and 10. Referring particularly to FIGS. 4 and 9, lift arm assembly 12 comprises, in pairs, a base pivot link 163, a pin 161 which connects the lower end of link 163 to mounting brackets welded to main frame 20 of the mine roof bolter, a base lift arm 167 which is connected by base pin 165 to link 163, a mounting bracket 169, a main lift arm 171 which extends to rotary drill head 11, a lifting assembly, and a leveling assembly. The main lift arms 171 and the base lift arms 167 are joined by a plurality of cross-members to form a rigid, rectangular lift arm frame.

Each main lift arm 171 is connected to rotary drill head 11 by means of a spherical bearing 39 and a stationary shaft 37, as seen in FIGS. 1, 2, and 5, which are part of the attachment assembly for the rotary drill head 11. Spherical bearing 39 is a spherical plain radial bearing, manufactured by The Torrington Company, Bearings Division, South Bend, Indiana, as Type SF which is a unit assembly consisting of a solid, spherical O.D. inner ring and a spherical I.D. outer ring. The outer ring has a single fracture to permit assembly. Both inner and outer rings are phosphate treated and then coated with molybdenum disulfide.

The lifting assembly comprises a rigid, strong horn 173 which is rigidly welded at its bottom to frame 20, an oscillating link 177, a horn pin 175 which connects the top of horn 173 to the front end of oscillating link 177, an oscillating link shaft 179 which pivotably joins together both main lift arms 171 and the rear end of oscillating link 177, and a main lift cylinder 181 which is connected at the bottom of its cylinder rod to main frame 20 and at its top to oscillating link 177 with cylinder pin 183, which is disposed approximately midway between pin 175 and shaft 179.

The leveling assembly comprises, in pairs a rear leveling lever 187 which is pivotally connected to oscillating link shaft 179, a tie-off rod 191, an upper tie-off pin 189 which pivotally connects rear leveling lever 187 to rod 191, a lower tie-off pin 193 which pivotally connects rod 191 to main frame 20, a rear leveling arm 195 which is outside of the lift arm frame but closely adjacent thereto and which is pivotally connected at its rear end to pin 189, a pair of front leveling levers 199 (straddling each lift arm 171) which are rigidly attached to each other and pivotally connected to lift arm 171 with a cross-over connecting pin 197 and the outer of which is pivotally connected to rear leveling arm 195 with a rear lever pin 201, a front leveling arm 203 which is inside of the lift arm frame and is attached at its rear end to the inner front leveling lever 199 with a rear lever pin which is coaxially aligned with pin 201 but is disposed on the inside of the lift arm frame, and a leveling pin (not shown in the drawings) which fits into a spherical plain radial bearing which is inserted in hole 36 in lugs 38, thus attaching the front end of arm 203 to rotary drill head 11.

Pins 165 and 197 are longitudinally aligned with shaft 37 and shaft 179. Pins 189 and 201 are longitudinally aligned with the pin within hole 36. Levers 187 and 199 have exactly the same length which is $4\frac{1}{8}$ inches in one preferred embodiment.

Figure 10:
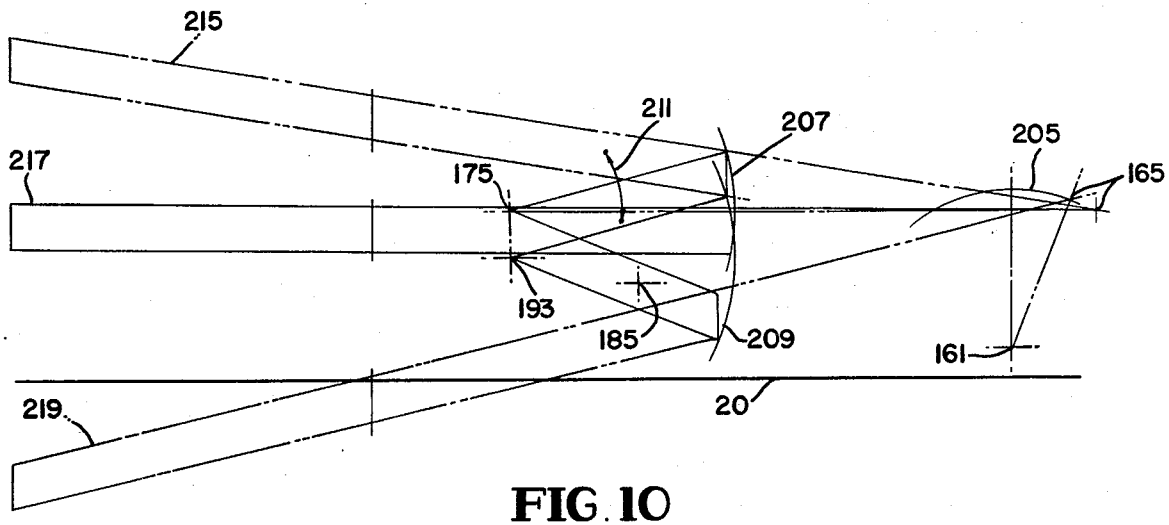
FIG. 10 is a schematic view that shows the lift arm in its raised, horizontal, and depressed positions.

As is known in the art, when the rod of cylinder 181 is extended, as seen in FIG. 9, the lift arm frame assumes the elevated position 215 indicated schematically in FIG. 10. When the cylinder rod is partially retracted, the lift arm frame typically assumes the horizontal posture 217. When the cylinder rod is fully retracted, the lift arm frame assumes the depressed posture 219, as seen in FIG. 10. In all positions, each shaft 37 is vertically aligned with the pin within hole 36 therebeneath as long as main frame 20 is horizontally disposed; thus rotary drill head 11 is controlled so that drill rod 21 is vertically disposed.

Panic bar assembly 17 comprises front panic bar 221, connecting rod 223, and shut-off bar 225, as seen in FIGS. 2 and 4. Front panic bar 221 is bent to conform to the left front corner of the roof bolter and is rigidly attached at its ends to levers which are pivotally mounted on the bottom plate of the roof bolter frame. The lever 229 at the corner of the machine pivots on pivot pin 227, fitted in brackets 228, and is pivotally attached to the outer end of connecting rod 223 with a clevis. The inner end of rod 223 is pivotally attached to shut-off bar 225, with a rod end ball joint 231 such as Type SPF-8 which is sold by the Superior Ball Joint Company, New Haven, Indiana, having a bearing raceway made of fiberglass-filled nylon 66 containing molybdenum disulfide as lubricant. Ball joint 231 permits a few degrees of angular misalignment which occurs when front panic bar 221 is depressed, thus moving connecting rod 223 rearwardly and slightly changing its angle of approach to front panic bar 221 and to shut-off bar 225 as it is pivoted into contact with electrical control switch 233. Light switch 232 is not contacted to shut-off bar 225.

The stabilizer foot 13, as seen in FIG. 1, comprises a sole 27, stabilizer main pin 28, a top cylinder pin 24 which is attached to horn 173, a bottom cylinder pin 26 which is attached to sole 27, and a hydraulic cylinder 25 which is attached to and operates between pins 23, 24.

Because it will be readily apparent to those skilled in the art that innumerable variations, modifications, applications, and extensions of the examples and principles hereinbefore set forth can be made without departing from the spirit and scope of the invention, what is herein defined as such scope and is desired to be protected should be measured, and the invention should be limited, only by the following claims.

What is claimed is:

1. In a rotary drill head apparatus for a mine roof bolter having a central dust suction means, a drill-bit-engaging means, a pinion-and-ring gear driving means, and inner and outer oil cavities within which bearings are rotatively operable, the improvement of a circulatory lubricating means, comprising:

A. an oil lift means for lifting oil upwardly from said inner oil cavity, said oil lift means comprising an oil lift ring having at least one finger which is downwardly inclined toward the direction of rotation, and said oil lift means being rotatively operable within said inner oil cavity for said lifting of said oil upwardly; and B. an oil movement means for upwardly and radially moving said oil to a position above said outer oil cavity, whereby said oil falls past said pinion-and-ring gear driving means, said oil movement means comprising a plurality of diagonally and radially disposed oil passageways that are formed in a seal plate and in a chuck which are rigidly attached to and supported by a cylindrical hub which separates said inner oil cavity from said outer oil cavity.

2. The improvement in the rotary drill head apparatus of claim 4 wherein said hub has a thrust-receiving end which is attached to said seal plate and a thrust-transmitting end which rotatively rests upon a plurality of thrust bearings past which said oil flows while toroidally circulating from said outer oil cavity to said inner oil cavity.

3. The improvement in the rotary drill head apparatus of claim 2 wherein said oil lift ring is attached to said hub.

4. The improvement in the rotary drill head apparatus of claim 3 wherein a ring gear is attached to said thrust-receiving end of said hub and is driven by a pair of pinions which are disposed 180° apart and connected to said pinion-and-ring gear driving means.

5. The improvement in the rotary drill head apparatus of claim 4 wherein said pinion-and-ring gear driving means is a pair of hydraulic motors, each being drivingly attached to one pinion of said pair of pinions and to a hydraulic drive motor.

6. A mine roof bolter, comprising a rotary drill head which comprises:

A. a stationary assembly, comprising a circumferential side, a bottom, a central cylindrical portion, and a dust transmission means for moving dust, which is produced by drilling in a mine roof, to a dust suction means, said dust transmission means comprising a passage which is coaxially disposed within said central cylindrical portion of said stationary assembly;

B. a rotative assembly, weighing at least about 100 pounds, which comprises:

(1) a cylindrical hub which forms an inner oil cavity with said central cylindrical portion and an outer oil cavity with said circumferential side, and (2) a means for lifting oil upwardly from said inner oil cavity and radially to said outer oil cavity;

C. a sealing means for preventing intermixture of dust, oil, and water, comprising:

(1) an outer mechanical seal which rotatively connects said stationary assembly to said rotating assembly and separates said outer oil cavity from contaminants in the surrounding environment, (2) an inner mechanical seal which rotatively connects said stationary assembly to said rotating assembly and forms a barrier between said dust within said dust transmission means and said oil in said inner oil cavity, (3) a rotary seal, disposed between said central cylindrical portion and a rotatable spindle insert which connects said passage to a hollow drill rod, which assists said inner mechanical seal, and (4) a plurality of static seals which are disposed between said dust transmission means and said oil cavities; and D. a dust collection assembly having a cleanout means which is readily accessible and easily operable, comprising a straight pipe, having readily removable end closures at each end thereof, which is attached to said bottom of said stationary assembly.

7. The mine roof bolter of claim 6 wherein said end closures are pipe plugs which are threadably attached to said ends of said straight pipe.

8. The mine roof bolter of claim 7 wherein said straight pipe is attached to the bottom of said rotary drill head and comprises inlet and outlet openings in the side thereof.

9. The mine roof bolter of claim 6 which further comprises a main frame and a lift arm assembly which comprises:

A. a lift arm frame, comprising a pair of elongated and spaced-apart lift arms, which is attached at the rear end thereof with a pivotable link to said main frame and at the front end thereof to said drill head;

B. a lifting assembly, comprising:

(1) a horn which is rigidly attached to said main frame, (2) an oscillating link which is pivotally attached at its front end to said horn and at its rear end to said pair of lift arms and is disposed longitudinally therebetween, and (3) a main cylinder which is pivotally attached to said main frame and to said oscillating link between said ends thereof; and C. a leveling assembly, comprising, in pairs:

(1) a rear leveling lever which is pivotally attached to said lift arm frame and to said rear end of said oscillating link, (2) a rear leveling arm which is disposed outside of said lift arm frame and is pivotally attached to said rear levelling lever at its near end, (3) a front leveling lever, as a pair straddling one said lift arm, which is pivotally attached to said rear leveling arm and to said one straddled lift arm to form a rear parallelogram, (4) a front leveling arm which is disposed inside said lift arm frame and is pivotally attached to said front leveling lever at its rear end and to said rotary drill head at its front end to form a front parallelogram, and (5) a tie-off rod which is pivotally attached to said rear levelling lever and to said main frame to form a lifting parallelogram, each of said parallelograms having the same transverse width at all positions of said lift arm frame.

10. A drill head apparatus for a mine roof bolter which comprises:

A. a stationary assembly, comprising:

(1) a case having a circumferential side and a bottom with a central hole therein, (2) a dust collection assembly which is connected to said central hole, (3) a spindle having a base portion, which is rigidly attached to said bottom, and a central cylindrical portion with an upper end and a coaxial opening therein which is aligned with said central hole, and (4) a seal retainer which is attached to and supported by said upper end;

B. a rotative assembly, comprising:

(1) a cylindrical hub which:

(a) coaxially surrounds and is radially spaced from said cylindrical portion of said spindle to define an inner oil cavity therebetween and is radially spaced from said circumferential side of said case to define an outer oil cavity therebetween, and (b) is vertically spaced at its lower end from said base portion of said spindle;

(2) a ring gear and a seal plate which are rigidly attached to and supported by said hub, said ring gear being coaxially disposed to and radially spaced outwardly from said hub, and said seal plate having a plurality of oil passageways therein;

(3) a chuck which is rigidly attached to said seal plate, comprising:

(a) a central opening which is aligned with said coaxial opening, (b) an inner recess which coaxially surrounds and is spaced from said seal retainer, (c) an outer recess which is coaxially connected to said inner recess by said central opening, (d) an outer circumferential flange, (e) a circumferential groove which is spaced radially inwardly from said flange, and (f) a plurality of oil passageways which are aligned with and connected to said oil passageways in said seal plate and which connect said inner oil cavity to said circumferential groove;

(4) an insert assembly, comprising:

(a) a cylindrical spindle insert which is inserted into and fits closely within:

(1) said coaxial opening within said cylindrical portion of said spindle, and (2) said central opening within said chuck, (b) a spacer which fits closely adjacent to said spindle insert and to said outer opening in said chuck, (c) a splined insert fits nonrotatably into splines along the edge of said outer opening in said chuck, and (d) an insert retainer which is attached to the chuck and immobilizes the splined insert;

C. a sealing means for preventing intermixture of dust, oil, and water, comprising:

(1) an outer mechanical seal which rotatively and sealably connects said side of said case to said flange, (2) an inner mechanical seal which rotatively and sealably connects said seal plate to said seal retainer, (3) a rotary seal between said spindle and said spindle insert, and (4) a plurality of static seals which are disposed between:

(a) said dust collection assembly and said bottom of said case, (b) said bottom of said case and said base portion of said spindle, (c) said spindle and said seal retainer, (d) said chuck and said seal plate, and (e) said chuck and said spindle insert;

D. a bearing assembly, comprising:

(1) thrust bearings which are disposed between said base portion of said spindle and said lower end of said hub and between said inner oil cavity and said outer oil cavity, (2) tapered roller bearings which are disposed in said inner oil cavity between said cylindrical portion of said spindle and the upper portion of said hub, and (3) roller bearings which are disposed in said inner oil cavity between said cylindrical portion of said spindle and said hub and between said thrust bearings and said tapered roller bearings;

E. a circulatory lubricating means, disposed within said inner oil cavity, for moving oil upwardly past said tapered roller bearings, between said seal retainer and said inner mechanical seal, and into said oil passageways; and F. a balanced drive means for rotating said rotating assembly, comprising:

(1) a pair of pinions which rotatably engage said ring gear and are rotatively attached to said side of said case at positions 180° apart within said outer oil cavity, and (2) a pair of hydraulic motors which are connected to said pinions and to a hydraulic drive motor.

11. In a rotary apparatus for rotating tubular members having a stationary assembly and a rotating assembly in which at least one sliding mechanical seal operates in a horizontal plane between portions of its stationary assembly and portions of its rotating assembly and above the surface of a bath of lubricating oil disposed within said apparatus, an improved overhead lubricating means for reaching and lubricating said at least one mechanical seal, comprising an oil lift ring having a coaxial opening and at least one splash surface which is downwardly inclined in the direction of rotation, said lift ring being attached to said rotating assembly in parallel to said surface and disposed in proximity thereto so that said at least one splash surface dips into said bath and forcibly throws large quantities of said oil upwardly when said rotating assembly is operating.

12. The improved overhead lubricating means of claim 11, wherein said at least one mechanical seal comprises an inner mechanical seal which is disposed above and spaced from said oil lift ring, said inner mechanical seal being lubricated by a portion of said upwardly throw oil.

13. The improved overhead lubricating means of claim 11, wherein said at least one sliding mechanical seal comprises an outer mechanical seal and wherein said rotating asssembly further comprises a plurality of radially disposed oil passageways having lower ends in flow connection with said upwardly thrown oil and upper ends disposed above said outer mechanical seal, whereby a portion of said upwardly thrown oil enters said oil passageways, is moved rapidly therethrough by centrifugal force, and falls onto said outer mechanical seal.

14. The improved overhead lubricating means of claim 13, wherein said oil portion falling onto said outer mechanical seal falls therefrom to said oil surface within an outer oil cavity and thence flows radially to an inner oil cavity wherein said oil lift ring is disposed, whereby there is a continual toroidal circulation of said oil while said rotating assembly is operating.

15. In a rotary apparatus for rotating tubular members in which a rotating assembly is sealably connected to a stationary assembly which encloses a fluid volume that is no more than 90% filled with lubricating oil when said oil is cold, whereby said lubricating oil forms an oil bath having a surface, and wherein at least one moving member requiring lubrication is disposed substantially above said surface, an improved overhead lubricating means for reaching and lubricating said at least one moving member comprising an oil lift ring having a coaxial opening and at least one splash surface which is downwardly inclined in the direction of rotation, said lift ring being attached to said rotating assembly in parallel to said oil surface and disposed in proximity thereto so that said at least one splash surface dips into said bath and forcibly throws large quantities of said oil upwardly when said rotating assembly is operating.

16. A readily accessible and easily operable cleanout means for a dust collection assembly in a mine roof bolter having a rotary drill head, comprising a straight-pipe, having readily removable end closures at each end thereof, which is:

A. attached to the bottom of said mine roof bolter;

B. a portion of a dust collection assembly for moving dust, produced by drilling in a mine roof, to a dust suction means; and C. in flow connection with the remaining portions of said dust collection assembly through inlet and outlet openings in the side of said pipe.

17. The cleanout means of claim 10, wherein said end closures are pipe plugs which are threadedly attached to said ends of said straight pipe.

18. A rotary drive apparatus for rotating an uprightly disposed member, comprising:

A. a rotating assembly to which said member is attached;

B. a stationary assembly which is connected to a supporting structure;

C. an oil bath having a surface, said oil bath being provided with approximately 10% expansion space above said oil surface;

D. at least one sliding mechanical seal which is disposed substantially above said surface and is parallel thereto; and E. a circular oil lift member which:

(a) is attached to said rotating assembly, (b) is disposed in parallel to said oil surface, (c) and has an inclined splash surface that dips into said oil bath and throws oil upwardly to reach and lubricate said at least one sliding mechanical seal.

19. The rotary drive apparatus of claim 18 wherein said upwardly thrown oil passes through radially disposed oil passageways before reaching said at least one sliding mechanical seal.

* * * * *